US008919740B2

(12) United States Patent
Carlsson et al.

(10) Patent No.: US 8,919,740 B2
(45) Date of Patent: Dec. 30, 2014

(54) BALCONY FENCE WITH INTEGRATED WIND SHIELD

(75) Inventors: Göran Carlsson, Piteå (SE); Lennart Carlsson, Piteå (SE); Linus Svensson, Luleå (SE); Maud Spencer, Luleå (SE)

(73) Assignee: Svalson AB, Öjebyn (SE)

( * ) Notice: Subject to any disclaimer, the term of this patent is extended or adjusted under 35 U.S.C. 154(b) by 78 days.

(21) Appl. No.: 13/498,574

(22) PCT Filed: Sep. 24, 2010

(86) PCT No.: PCT/SE2010/051029
§ 371 (c)(1), (2), (4) Date: Mar. 27, 2012

(87) PCT Pub. No.: WO2011/040866
PCT Pub. Date: Apr. 7, 2011

(65) Prior Publication Data

US 2012/0181497 A1 Jul. 19, 2012

(30) Foreign Application Priority Data

Sep. 29, 2009 (SE) ..... 0901249

(51) Int. Cl.
*E04H 17/16* (2006.01)
*E04B 2/74* (2006.01)
*E04F 11/18* (2006.01)

(52) U.S. Cl.
CPC ..... *E04B 2/7424* (2013.01); *E04F 11/18* (2013.01); *E04F 11/1851* (2013.01)
USPC ..... 256/24; 256/11; 52/204.51

(58) Field of Classification Search
CPC ..... E01F 13/048; E04H 17/16; E04H 17/00; E06B 3/4423
USPC ..... 256/11, 24, 25, 73, DIG. 1; 525/204.51; 52/204.51, 204.5
See application file for complete search history.

(56) References Cited

U.S. PATENT DOCUMENTS

| | | | | | |
|---|---|---|---|---|---|
| 835,241 | A | * | 11/1906 | Gilbreth | 49/447 |
| 1,933,916 | A | * | 11/1933 | Lochner | 52/204.51 |
| 4,529,174 | A | * | 7/1985 | Pickett | 256/27 |
| 4,905,970 | A | | 3/1990 | Holmsten et al. | |
| 6,123,321 | A | * | 9/2000 | Miller | 256/25 |
| 2010/0001245 | A1 | * | 1/2010 | Drax | 256/17 |
| 2011/0227016 | A1 | * | 9/2011 | Iffergan | 256/73 |

FOREIGN PATENT DOCUMENTS

| | | | |
|---|---|---|---|
| DE | 29621995 | U1 * | 2/1997 |
| DE | 298 07 218 | | 10/1998 |
| EP | 1452671 | A1 | 9/2004 |

OTHER PUBLICATIONS

International Search Report received for PCT Patent Application No. PCT/SE2010/051029, mailed on Jan. 3, 2011, 4 pages.

* cited by examiner

*Primary Examiner* — Michael P Ferguson
*Assistant Examiner* — Jonathan Masinick
(74) *Attorney, Agent, or Firm* — Morrison & Foerster LLP

(57) ABSTRACT

A balcony fence includes an integrated wind shield of adjustable glazed panels that can be raised and lowered. The balcony fence with the integrated glazed panels is provided with lamellar glass both in its lower fixed part and in the part that can be raised and lowered. The balcony fence with the integrated glazed panels also includes a counterweight balancing mechanism.

1 Claim, 1 Drawing Sheet

BALCONY FENCE WITH INTEGRATED WIND SHIELD

CROSS REFERENCE TO RELATED APPLICATIONS

This is a U.S. National Phase patent application of PCT/SE2010/051029, filed Sep. 24, 2010, which claims priority to the Swedish Patent Application No. 0901249-3, filed Sep. 29, 2009, each of which is hereby incorporated by reference in the present disclosure in its entirety.

BACKGROUND OF THE INVENTION

1. Field of the Invention

The present invention relates to a system for a balcony fence with an integrated wind shield of adjustable glazed panels that can be raised and lowered.

2. Description of the Related Art

Balcony fences are available in a number of designs, from simple protective fences to decorated fences of metal railings. The material of the balcony fences may consist of concrete, railings, corrugated iron, wood, aluminium, glass, etc. The purpose of a balcony fence is to protect people who are on the balcony from falling off. The balcony fence is not to block the view, and the balcony is to be protected from strong winds. There are several solutions, in the form of thin cast iron railings on balconies, which do not disturb the view, or solid sheets, which protect from the wind. Extra equipment in the form of balcony protection of fabric that can be attached to an existing balcony fence in order to protect from the wind is also used. These, however, are not sufficiently flexible or easy to use in order to satisfy the different needs of openness and wind protection. It is therefore necessary for the user to give priorities to the different needs. Many users mount a framework with fabric, which may be either permanently fixed in place or freely dismountable, such that the fabric can be drawn to be either protecting or withdrawn. The protection provides shelter from the wind, but gives at the same time a feeling of being enclosed, and it disturbs the free view from the balcony.

When enclosing balconies in glass, several vertical frames with glass are mounted next to each other above the existing balcony fence. These glass sheets can subsequently be displaced sideways such that a part of the balcony can be opened. Such glazing requires a more complicated mounting, with rails at the top and bottom of the balcony, i.e. at the floor and ceiling. Enclosure in glass can be carried out only on balconies that have a covering roof. It is desirable for a housing cooperative to have a similar aesthetic appearance for all balconies in the building. Today, it can occur that the occupiers of the apartments install different models of protection.

SUMMARY OF THE INVENTION

It is, therefore, one purpose of the present invention that the problems described above are eliminated or at least considerably reduced through providing a system for a balcony fence with an integrated wind shield of adjustable glazed panels that can be raised and lowered. The balcony fence with the integrated glazed panels is provided with lamellar glass both in its lower fixed part and in the part that can be raised and lowered. The balcony fence with the integrated glazed panels as wind shield has been created with the idea in mind that it is to be easy to use, and that raising and lowering is to be possible with a single hand operation. It is possible for the user to determine the desired height of the glazed panels, due to counterweight balancing.

The balcony fence with the integrated wind shield is provided with lamellar glass both in its lower fixed part and in the part that can be raised and lowered. The glass sheet in the upper part can be adjusted such that it is open as much as is required. It can be lowered to a fully open position and it can be raised to give full wind protection. The balcony fence has fixed glass sheets between the balcony pillars, in which also the glazed panels are integrated such that they can move vertically upwards and downwards in the pillars. The glazed panels are constituted by lamellar glass and are balanced against a counterweight. Lines are attached on each side of the counterweight. The lines run over a break wheel at the upper edge of the balcony pillars and are attached at their second ends to the lower edge of the glazed panel. The lines are hidden and run in the pillars of the balcony fence. The glazed panel remains in the desired position after it has been raised.

One embodiment of the invention is described below, and it is illustrated in the attached drawings, in which

DETAILED DESCRIPTION OF THE INVENTION

Figure 1:
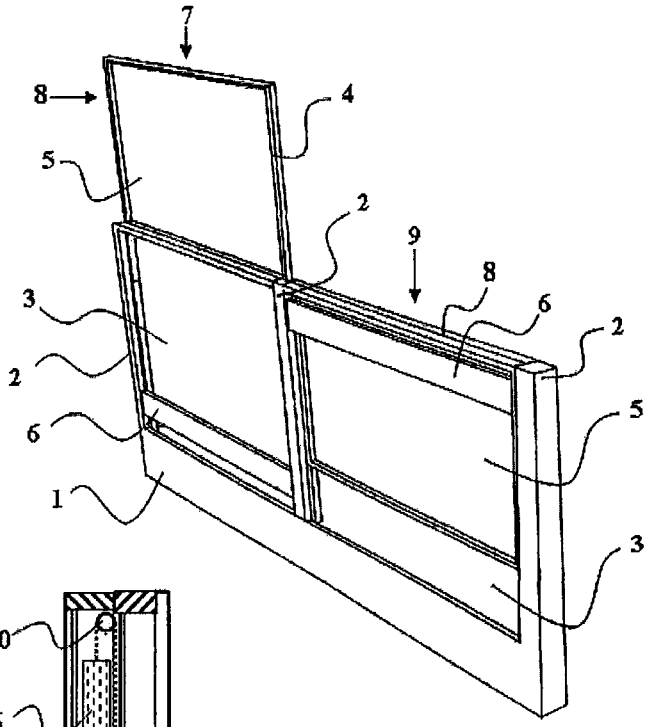
FIG. 1 shows a perspective view of a balcony fence with an integrated wind shield of adjustable glazed panels that can be raised and lowered.
Figure 2:
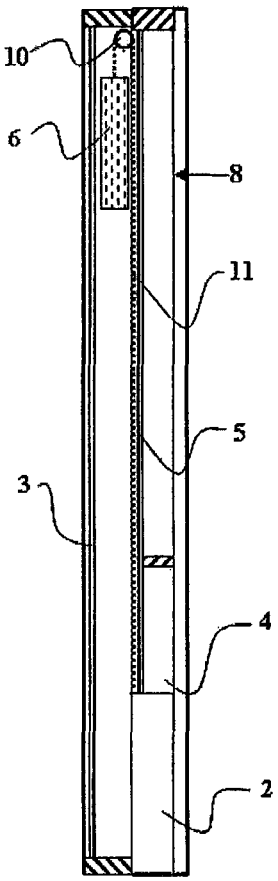
FIG. 2 shows a principle sketch in section of the balcony fence with the adjustable glazed panel at its lower position and with the compensating counterweight at its upper position.
Figure 3:
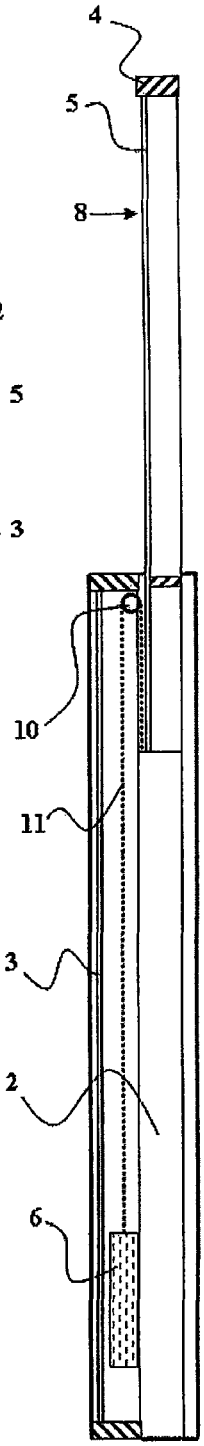
FIG. 3 shows a principle sketch in section of the balcony fence with the adjustable glazed panel at its upper position and with the compensating counterweight at its lower position.

A balcony fence with an integrated wind shield of adjustable glazed panels that can be raised and lowered as shown in FIGS. 1, 2, and 3 may represent the building form that is applied in the example intended here.

FIG. 1 shows a balcony fence with an integrated wind shield of adjustable glazed panels that can be raised and lowered. In detail the figure shows a perspective view of a balcony fence 1 with two adjustable glazed panels 8 and where one section 7 shows how the glazed panel 8 is set in a raised position and the other section 9 shows how the glazed panel 8 is set in a lowered position. The balcony fence 1 has fixed glass sheets 3 between the balcony pillars 2, in which also the glazed panels 8 are integrated such that they can move vertically upwards and downwards in the pillars 2. The glazed panel 8 is constituted by lamellar glass 5 in a frame 4. The glazed panel 8 is balanced by a counterweight 6 such that it can be raised and lowered by a single hand operation. The drawing shows one section 7 of the balcony fence 1 with a raised glazed panel 8 and how the counterweight 6 has moved to the lower position. The glazed panel 8 is shown lowered in the other section 9 of the balcony fence 1, and this shows how the counterweight 6 is located at the upper position.

FIG. 2 shows a balcony fence with an integrated wind shield of adjustable glazed panels that can be raised and lowered. In detail the figure shows a principle sketch in section of the balcony fence 1 with the adjustable glazed panel 8 in its lower position and with the compensating counterweight 6 at its upper position. Lines 11 are attached on each side of the counterweight 6. The lines 11 run over a break wheel 10 at the upper edge of the balcony pillars and are attached at their second ends to the lower edge of the glazed panel 8. The lines 11 run inside the balcony pillars 2.

FIG. 3 shows a balcony fence with an integrated wind shield of adjustable glazed panels that can be raised and lowered. In detail the figure shows a principle sketch in section of the balcony fence 1 with the adjustable glazed panel 8 raised to its upper position, whereby the compensating counterweight 6 is located at its lower position. Lines 11 are attached on each side of the counterweight 6. The lines 11 run over a break wheel 10 at the upper edge of the balcony pillars and are attached at their second ends to the lower edge of the glazed panel 8. The lines 11 run inside the balcony pillars 2.

The invention has been described in accordance with the preferred summary and design, and it is to be understood that certain exchanges and modifications may be carried out without deviating from its concept. It is shown in the design described here how the glazed panel is constituted by lamellar glass inside a frame. Alternative designs are, however, possible: the glazed panel may, for example, be constituted by lamellar glass without a frame. In the same way, the balcony fence with the integrated glazed panel may be manufactured from another material than glass. The glazed panel may also be provided at its upper edge at one of the balcony pillars with a catch that locks the glazed panel against the balcony pillar such that it cannot be driven downwards during the complete period under which the glazed panel is being raised, thereafter to be locked in the desired position. In order to lower the glazed panel, the catch is manually held depressed during the period under which the glazed panel is being lowered. The invention is thus not to be considered to be limited to what has been revealed and described above: similar variants are included in the innovative concept and must be considered to be included within the scope of the attached patent claims.

The invention claimed is:

1. A balcony fence comprising:

an integrated wind shield comprising an adjustable glazed panel that can be raised and lowered;

balcony pillars; and fixed glass sheets mounted between the balcony pillars, wherein the glazed panel is configured such that it can run vertically up and down in the balcony pillars and wherein the glazed panel comprises lamellar glass in a frame and wherein the glazed panel is balanced by a counterweight, wherein the balcony pillars of the balcony fence are vertical and have a height that extends only to an upper edge of the fixed glass sheets between the balcony pillars, wherein, when the adjustable glazed panel is in a raised position, the adjustable glazed panel extends above an upper end of the balcony pillars, wherein, when the adjustable glazed panel is in a lowermost position, no part of the frame is above an upper end of the balcony fence, wherein the counterweight horizontally extends so as to have two ends, one end being located in a first pillar and the opposed end being located in an adjacent pillar, and lines are attached on each end of the counterweight, which lines run inside the balcony pillars and onwards over a break wheel at the upper end of the balcony pillars and down to another end, at which the lines are attached to a lower edge of the glazed panel.

* * * * *